US005682786A

United States Patent [19]

Hahn

[11] Patent Number: 5,682,786

[45] Date of Patent: Nov. 4, 1997

[54] DOUBLE ACTION CONTAINER DOMER

[76] Inventor: Roger A. Hahn, 16576 W. 51st Pl., Golden, Colo. 80403

[21] Appl. No.: 591,307

[22] Filed: Jan. 25, 1996

[51] Int. Cl.[6] ..... B21D 22/00; B21D 22/21; B21C 37/02

[52] U.S. Cl. ..... 72/348; 72/379.4

[58] Field of Search ..... 72/348, 379.4, 72/449, 347, 349, 345; 74/110

[56] References Cited

U.S. PATENT DOCUMENTS

| | | | |
|---|---|---|---|
| 2,075,847 | 4/1937 | Hothersall . | |
| 2,914,955 | 12/1959 | Colborne et al. | 74/110 |
| 3,010,328 | 11/1961 | Forey | 74/110 |
| 4,289,014 | 9/1981 | Maeder et al. | 72/348 |
| 4,589,270 | 5/1986 | Lee, Jr. . | |
| 4,620,434 | 11/1986 | Pulciano et al. | 72/348 |
| 4,930,330 | 6/1990 | Weishalla | 72/348 |

*Primary Examiner*—Lowell A. Larson
*Assistant Examiner*—Rodney A. Butler
*Attorney, Agent, or Firm*—Timothy J. Martin; Michael R. Henson

[57] ABSTRACT

A forming apparatus for doming containers employs a pair of pistons, a pressure ring and doming die. One piston carries the pressure ring, and the other piston carries the doming die. The pistons are mechanically linked so that they move in a counteracting manner thus reducing the stroke distance necessary to dome the container. This further reduces the impact energy on the container. The mechanical linkage is preferably pairs of rack and pinion gears moving the pistons in opposite directions of travel.

23 Claims, 5 Drawing Sheets

DOUBLE ACTION CONTAINER DOMER

FIELD OF THE INVENTION

The present invention broadly relates to the manufacturer of containers, especially drawn and iron steel or aluminum containers such as used in the food and beverage industry. More particularly, the present invention concerns the formation of a bottom profile of a container to provide mechanical strength when it is filled and pressurized.

BACKGROUND OF THE INVENTION

The need for packaging of food and beverage products for storage and sale has increased as populations have risen and urbanization intensified. In addition, the demand for convenient, ready-to-eat products have added to the demand for suitable packaging. A long standing technique for packaging certain foods and beverages is the familiar cylindrical container or can that is typically formed out of steel or aluminum.

The rising demand for steel and aluminum containers, though, generates concerns about production costs and the quantity of material used in the fabrication process for these containers. Accordingly, there have been intensified efforts to reduce the wall diameter of steel and aluminum cans in order to reduce the weight and mass of raw material used to create a can of given volume. This saves in the costs of production, in two ways. By reducing the quantity of material, lower material costs are obtained. Moreover, the energy required to refine or recycle the material is reduced. A derivative advantage is a reduction in the need for raw materials that must be extracted from the natural resource base.

The reduction in the wall size of containers, however, is not without its problems. While a reduced wall thickness is highly desirable from a material standpoint, structural integrity of the container must be maintained. Since the reduced wall thickness of a container diminishes its inherent strength, improved geometries have been developed to give added strength to the design. An example of such a geometry is the formation of a concave depression in the bottom of a container with this concave depression being commonly referred to as a dome.

Providing the bottom of a container with an inwardly projecting dome has several advantages. First and foremost, such a dome provides structural rigidity to the container, especially where the internal contents of the container are pressurized. This is of particular importance to the beverage industry where carbonated beverages are packaged in the container for storage and sale. Here, the dome structure greatly increases the resistance of the container to expansion or "bloating" so as to maintain integrity of the container while at the same time maintaining the contents of the container in the desired pressurized state. Finally, such a dome provides a surrounding rim that provides a planar contact surface so that the container may rest in a stable manner on a shelf or other storage location.

In the past, container domers have been used to form the dome structure in the bottom of a drawn and iron steel or aluminum containers. The domer is associated with the bodymaker or can forming machine by means of a support framework or mounting bracket. The bottom structure is formed at the end of the draw and iron cycle. Here, a punch or ram carrying the can body through the draw and iron dies includes at its distal end a die structure corresponding to the interior of the desired container bottom. This ram is usually driven by an arm connected to a rotating crank. At the end of the stroke carrying the container body through the press, the container bottom and punch strike against the bottom former, that is, the container domer. The bottom former includes a die structure which is configured to match the shape of the punch thereby to stamp the bottom profile in the container.

The bottom or can domers which have heretofore been used include a pressure ring and domer die which are connected to an air piston cylinder connected to a pressurized air source. The pressurized chamber of the air cylinder which receives the piston associated with the pressure ring and domer die provides a resilient cushion of compressed air to cushion the impact of the bottom of the container against the domer die. This allows for control of metal flow as the dome is formed.

In an aluminum can, for example, that is used in the beverage industry, it is desired that the dome be approximately 0.400 inch. Due to the compression of the gas in the pressurized cylinder, it is often required that the throw distance of the ram, after contact with the can bottom, be at least 0.700 inch to create a dome of the desired height. This requires engagement of the can bottom and the domer die at a point in the rotation of the rotating crank of the bodymaker that is sufficiently early to create this throw distance. As a result, it is not uncommon for the ram to be travelling at a speed of approximately twenty feet per second when the can bottom panel first strikes the domer die. Thus, the impact energy is relatively high which can cause excessive wear to the container domer assembly.

It would be desirable if the impact energy of the ram onto the container domer could be reduced. A way of doing this would be to reduce the stroke length necessary during the doming process thereby allowing the ram carrying the unformed container to strike the pressure ring and doming die nearer to the bottom of the rotating crank cycle.

SUMMARY OF THE INVENTION

It is an object of the present invention to provide a new and useful container domer that is used to form the bottom profile of a container thereby to increase the mechanical strength of a container when it is filled and pressurized.

Another object of the present invention is to provide a double action domer usable with a cam driven bodymaker which domer is able to form a dome structure in a container at a later point in the cam cycle of the bodymaker thereby to reduce the impact energy affecting the domer.

Yet another object of the present invention is to provide a container domer that utilizes a dual or double action of countermoving dies to produce a desired bottom profile in the bottom panel of a container.

A further object of the present invention is to provide a can domer of simplified mechanical structure that is inexpensive to produce and easy to maintain.

Still a further object of the present invention is to provide a can domer that will retrofit onto existing bodymaker/can forming machines.

To accomplish these objects, then, the forming apparatus according to the present invention is a container domer operative to form a dome structure in the bottom panel of the container wherein the container has a bottom peripheral edge surrounding the bottom panel. Broadly, the forming apparatus includes a first piston that is reciprocally movable relative to the support frame which may be a bracket mountable in a traditional bodymaker or can forming machine. The first piston moves in opposite first and second directions. A second piston is reciprocally movable in the first and second directions relative to the first piston. A mechanical linkage interconnects the first and second pistons such that movement of one of the pistons causes countermovement of the other in an opposite direction. Suitable piston seals are provided for both the first and second pistons.

A pressure ring is disposed on the first piston and is operative to engage the bottom peripheral edge of the container with this pressure ring being configured to reform the bottom peripheral edge to produce a desire shoulder profile as a container is forcibly advanced in the first direction. A doming die is then disposed on the second piston and is operative to engage the bottom panel of the container. The doming die is configured to deform the bottom panel into a desired dome structure as the container is forcibly advanced in the first direction relative to the second piston. The double action, countermovement of the first and second pistons, then, form the bottom of the container or can including the shoulder profile and the dome structure.

Preferably, the mechanical linkage which interconnects the two pistons is a gear drive. This drive includes at least one, but preferably a plurality of gear sets. Each of the gear sets includes a first gear rack secured to the first piston, a second gear rack secured to the second piston and a pinion gear rotatably journaled relative to the support frame. The pinion gear engages both the first and second gear racks whereby linear movement of the first gear rack causes linear movement of the second gear rack in an opposite direction. Where a plurality of gear sets are included, they are preferably equiangularly spaced around a longitudinal axis. These gear sets may be rotatably journaled on brackets mounted to a back plate that is disposed at an end of the first and second cylinders opposite the pressure ring and domer die.

To this end, it is preferred that the forming apparatus include a piston housing that is secured to the support frame with an interior formed by a surrounding sidewall extending longitudinally from a top end to a bottom end. The first piston is then formed as a shell, preferably cylindrical, having an outer piston wall and an inner piston wall surrounding a piston interior. This first piston is disposed in the housing interior and is axially aligned with the longitudinal axis so that it may reciprocate in a first direction toward the bottom end and in an opposite second direction toward the top end with the outer piston wall sliding alongside the surrounding sidewall of the piston housing. The second piston, preferably cylindrical in shape, is disposed in the piston interior and is axially aligned with the longitudinal axis.

In the preferred embodiment, the piston housing includes an outer flange that is secured to the support frame, and a resilient die spring is interposed between the flange and the support frame. An eccentric adjustment assembly is provided to align the longitudinal axis with the ram of the bodymaker. Here, the support frame may include a circular opening to receive the piston housing, and the eccentric assembly may be a pair of annular eccentric elements insertable into the opening and clamped to the support frame in a surrounding relation to the piston housing between the piston housing and the support frame.

It is preferred that the first and second pistons be coaxial and be retained in the piston housing between a retaining ring and a back plate. The piston retaining ring acts to provide a limit stop to limit travel of the first piston in the second direction and thereby limit travel of the second piston in the first direction. A second annular piston retaining ring may be disposed on a top portion of the first piston and is operative to limit travel of the second piston in the second direction and thereby limit travel of the first piston in the first direction.

An air piston may be disposed on the bottom end of the piston housing and is operative to cushion the first piston against movement in the first direction and, correspondingly, movement of the second piston in the second direction. The air piston also helps eject the formed container. Here, a source of pressurized air is provided for connection to the air piston. Where a backing plate is provided, the air piston may include a plurality of air piston rods extending longitudinally through respective bushings mounted in holes formed in the backplate. These piston rods are preferably equiangularly spaced about the longitudinal axis.

These and other objects of the present invention will become more readily appreciated and understood from a consideration of the following detailed description of the exemplary embodiment when taken together with the accompanying drawings, in which:

BRIEF DESCRIPTION OF THE DRAWINGS

FIG. 2(*b*) is a side view in partial cross-section of the container shown in 2(*a*) after the dome structure is formed therein;

DETAILED DESCRIPTION OF THE EXEMPLARY EMBODIMENT

The present invention is directed to a double action container domer or forming apparatus that is adapted to form a dome structure in a bottom panel of a container in order to increase the mechanical strength of the container, especially when it is filled and pressurized. An important aspect of the present invention is the use of first and second pistons which are reciprocally movable with respect to one another in opposite directions and which are linked for countermovement during the formation of a dome structure in the bottom panel of a container. The present invention is designed to be mounted to a standard bodymaker or can forming machine so that, as the container exists the bodymaker, it may be stamped onto the container domer of the present invention thereby to form the desired dome structure.

Figure 1:
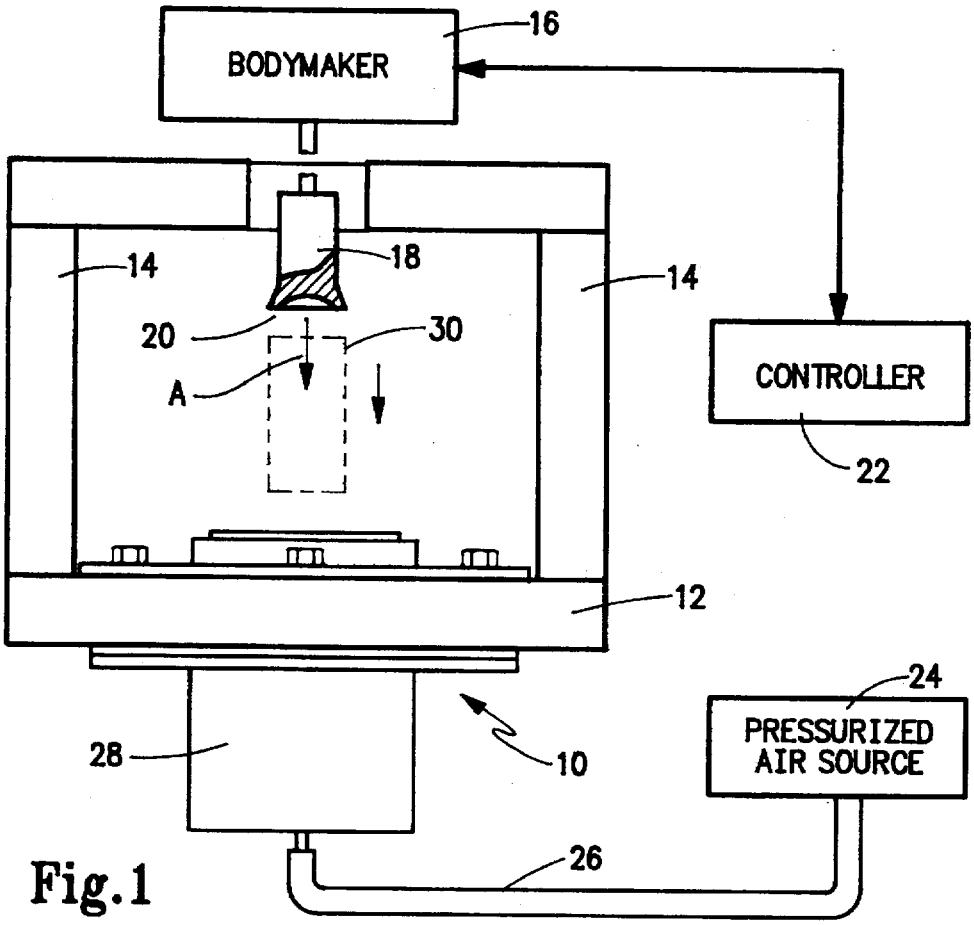
FIG. 1 is a diagrammatic view showing the forming apparatus of the present invention in the environment of a container bodymaker.

Accordingly, as is shown in FIG. 1, the forming apparatus 10 of the present invention is shown mounted to a support frame 12 which, as depicted in this Figure, includes brackets 14 associated with a can forming machine or bodymaker 16 which includes both a tool pack and a ram 18 which ram reciprocates to draw and iron an exemplary steel or aluminum container from a sheet of material. Such a container 30 is here shown in phantom. As is shown in this Figure, ram 18 includes a die profile 20 which is the female portion of the die used to create a desired dome structure. This profile 20 may be of any desired selected configuration as is known in the art. Moreover, it should be appreciated that can 30 (in phantom) and ram 18 are shown separated in FIG. 1, for purposes of explanation. However, in operation, ram 18 would be actually be positioned internally of the container 30.

As described more thoroughly below, forming apparatus 10 of the present invention is operated in response to the linear movement of ram 18 in the direction of arrow "A". After the dome structure is formed in container 30, it is assisted out of forming apparatus 10 by means of an air cylinder assembly 28 which is connected to a pressurized air source 24 by means of a suitable conduit 26. A controller 22 controls bodymaker 16 as well as receiving positioning information from bodymaker 16 indicating the relative position of ram 18 during the dome structure forming cycle.

Figure 2A:
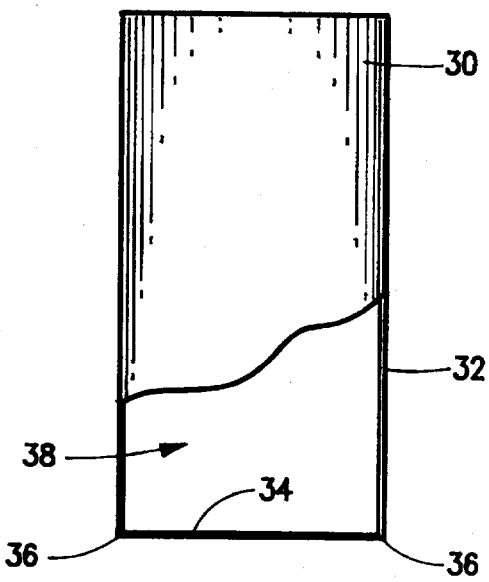
FIG. 2(*a*) is a side view in partial cross-section showing an exemplary embodiment of a container prior to having a dome structure formed therein.
Figure 2B:
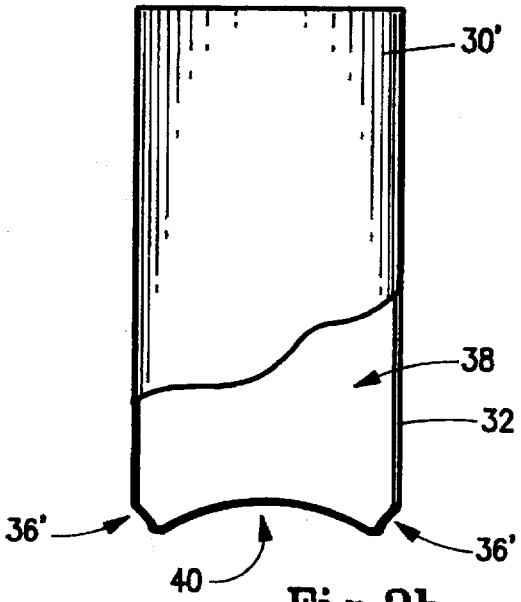

With reference to FIGS. 2(*a*) and 2(*b*), it may be seen that an unformed container 30 is shown in FIG. 2(*a*) in a condition after it has exited bodymaker 16. Here, representative container 30 is in the form of a cylindrical can including a surrounding sidewall 32 and a bottom panel 34 surrounded by a bottom peripheral edge 36 to enclose an interior 38 for container 30. In FIG. 2(*b*), however, it may be seen that container 30' has now had a dome structure 40 formed in bottom panel 34 and peripheral edge 36. More specifically, it may be seen in FIG. 2(*b*) that bottom peripheral edge 36 has been reformed into a desired shoulder profile 36' with dome structure 40 being in the form of a concave depression projecting into the interior 38 of container 30'. For sake of the following explanation of the exemplary embodiment, the container, whether before forming or after forming will be referred simply by the reference numeral "30".

In order to form container with a desired dome structure and shoulder profile, such as dome structure 40 and shoulder profile 36', the forming apparatus 10 of the present invention mates with the ram 18 so that ram 18 operates to forcibly advance container 30 into forming apparatus 10. Forming apparatus 10 is best shown in an in FIGS. 3–5. FIGS. 6(*a*)–6(*d*) respectively show consecutive steps in the formation of the dome structure 40 into bottom panel 34 of container 30.

Figure 3:
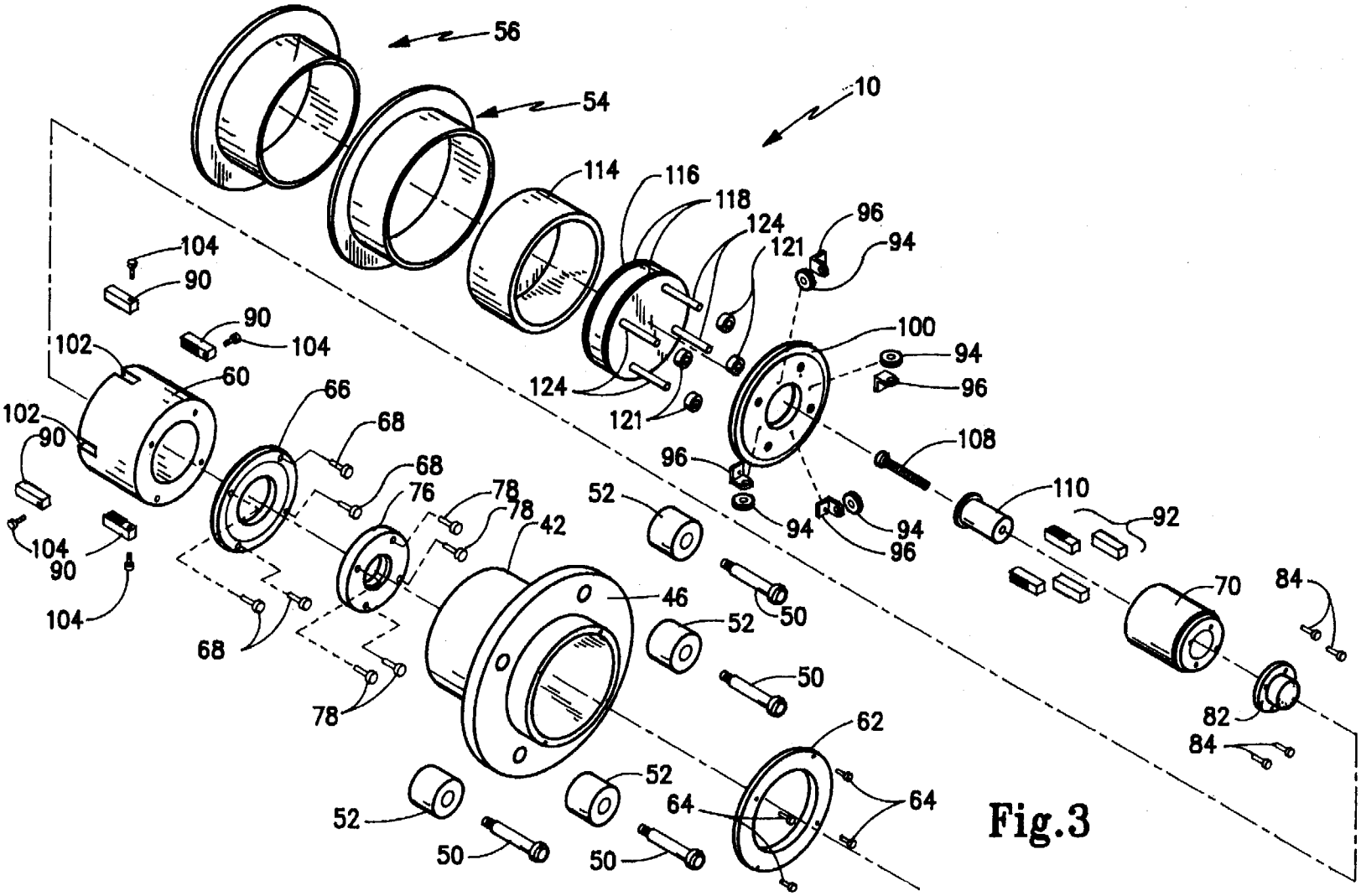
FIG. 3 is an exploded perspective view of the container domer according to the exemplary embodiment of the present invention.
Figure 4:
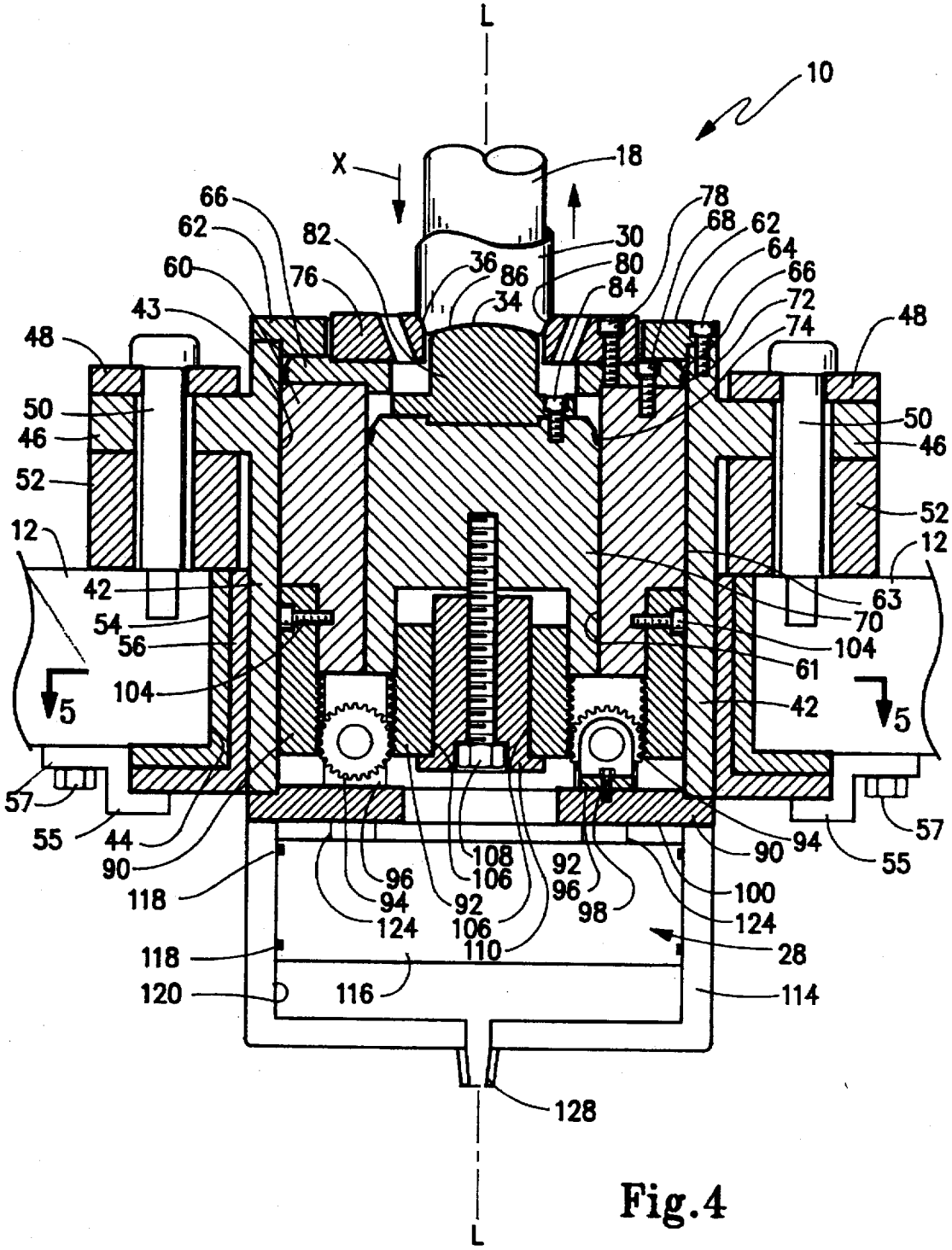
FIG. 4 is a side view in partial cross-section showing the exemplary embodiment of the present invention.
Figure 5:
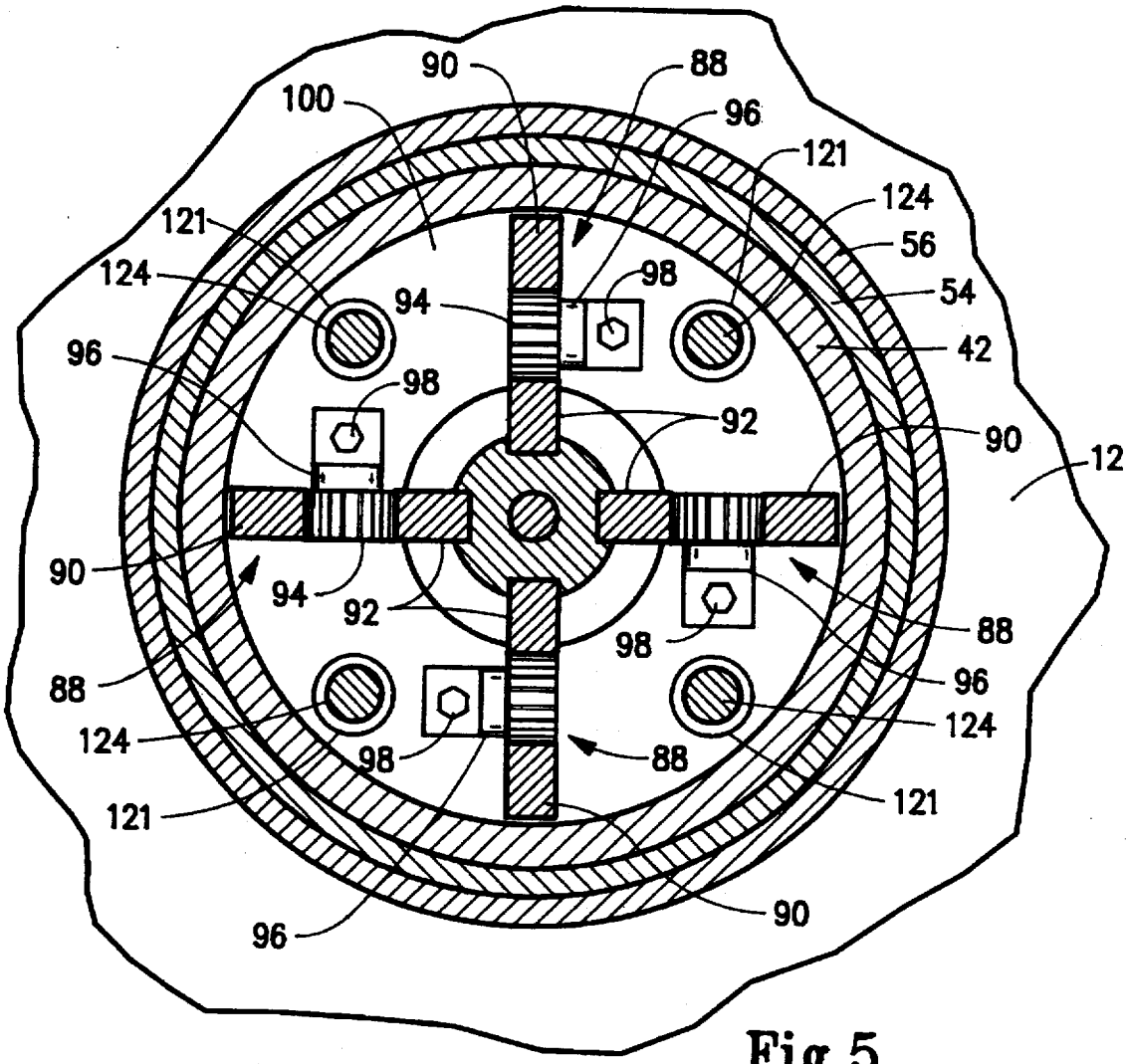
FIG. 5 is a cross-sectional view taken about lines 5—5 of FIG. 4.
Figure 6A:
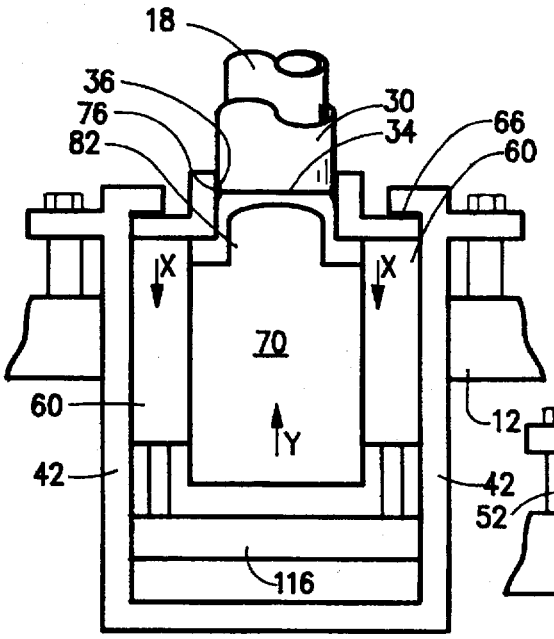
FIG. 6(*a*)–6(*d*) are diagrammatic views illustrating the forming cycle of the exemplary embodiment of the present invention.
Figure 6B:
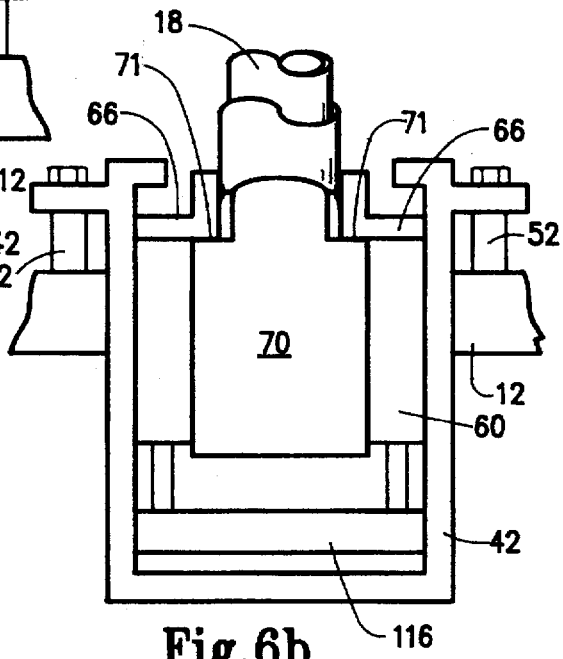
Figure 6C:
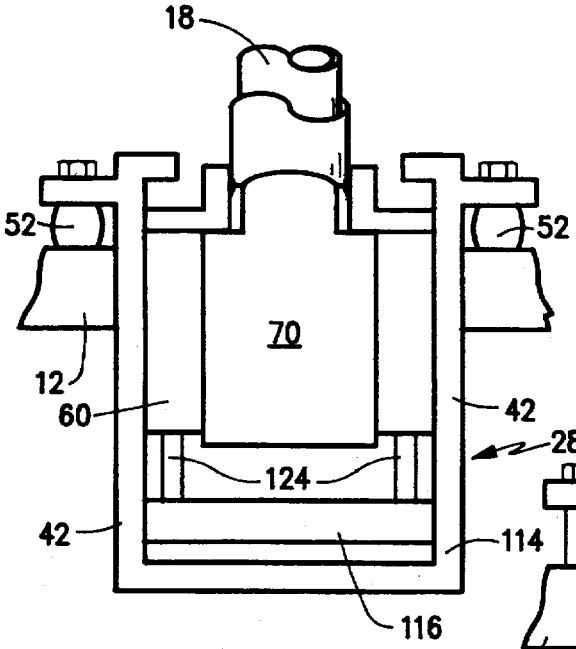
Figure 6D:
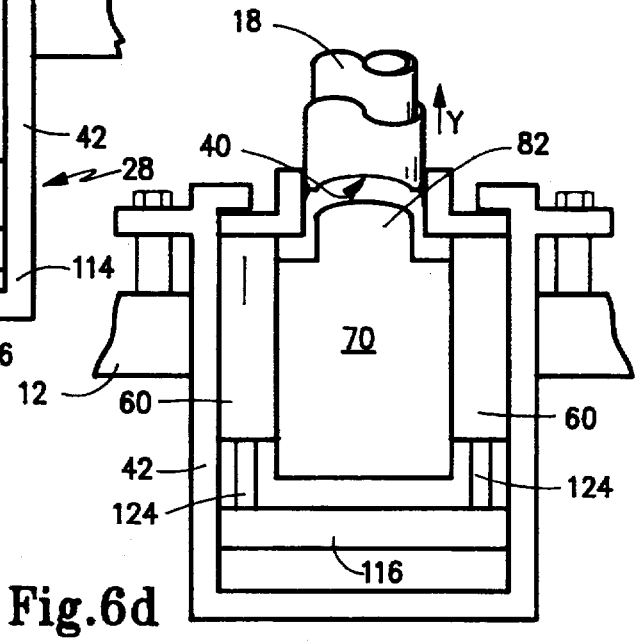

Turning to FIGS. 3–5, then, it may be seen that forming apparatus 10 is mounted on a support frame 12 and includes a piston housing 42 that is preferably in the form of a cylindrical sleeve that is insertable into a circular opening 44 formed in support frame 12. Piston housing 42 includes an outwardly projecting flange 46 which may be bolted into support frame 12 by means of an annular washer 48 and bolts 50. Bolts 50 extend through urethane die springs 52 which provide a resilient cushioning affect, as described more thoroughly below. A pair of telescopic annular eccentric elements 54 and 56 extend into opening 44 and are interposed between support frame 12 and the sidewall 58 of piston housing 42. Eccentric elements 54 and 56 may be rotatably positioned to align housing 42 such that its longitudinal axis "L" may be aligned with the throw line of ram 18, with longitudinal axis "L" preferably being perpendicular to support frame 12. Eccentric elements 54 and 56 are held in position on support frame 12 by clamping brackets 55 and bolts 57.

A first piston 60 is reciprocally movable in opposite first and second directions relative to support frame 12 and is retained in a mounted state in the interior of piston housing 42 by means of a piston retaining ring 62 which is secured at a first end of housing 42, for example, by machines screws 64. A second piston retaining ring 66 is fastened by means of screws 68 to a first end of first piston 60. As is shown in these Figures, first piston 60 is preferably in the form of a cylindrical shell.

Piston retaining ring 66 acts to retain a second piston 70 in the interior of first piston 60 with second piston 70 being reciprocally movable in the first and second direction relative to first piston 60. Second piston 70 is sized and adapted for close-fitted, mated sliding engagement with the inner sidewall 61 of first piston 60 while the outer wall 63 of first piston 60 is sized for close-fitted, mated sliding engagement with the inner wall 43 of piston housing 42. Suitable ring seals 72 and 74 are respectively associated with first and second pistons 60 and 70 and are provided to maintain a relative fluid tight seal as first and second pistons 60 and 70 slide relative to housing 42 and with respect to one another.

With reference still to FIGS. 3–5, but with particular reference to FIGS. 3 and 4, it may be seen that an annular pressure ring 76 is mounted onto piston retaining ring 66 by means of screws 78 with pressure ring having a die profile 80 that is operative to engage the bottom peripheral edge 36 of container 30 and adapted to reform bottom peripheral edge 36 to produce a desired shoulder profile as container 30 is forcibly advanced in the first direction "x" under the movement of ram 18 in the direction of "A" (FIG. 1). A doming die 82 is mounted at an upper or first end of piston 70 by means of screws 84. Doming die 82 is configured to have an upper profile 86 configured to form bottom panel 34 into the desired dome structure 40 as the container is forcibly advanced in the first direction. Doming die 82, then, provides male die which mates with the female profile 20 of ram 18, as shown in FIG. 1.

An important feature of the present invention is the dual or double action of this container domer wherein first piston 60 and second piston 70 move in opposite directions with respect to one another during the formation of dome structure 40. This double action substantially reduces the length necessary for the stroke of the ram after the container impacts the pressure ring 62 and the doming die 82; this, in turn, reduces the speed of the ram and thus the impact energy.

Accordingly, it is necessary to mechanically link first and second pistons 60 and 70 for this countermovement along the longitudinal axis "L". While this mechanical linkage might well be toggle levers or other mechanical constructs as may be designed by the ordinarily skilled engineer in this field, the preferred mechanical linkage according to the exemplary embodiment of the present invention is a gear drive. However, for sake of explanation, reference will again be made to FIGS. 3–5. As is seen in these Figures, the gear drive which interconnects the first and second pistons is formed by a plurality of rack gear sets 88. Each rack gear set 88 includes a first rack gear 90 secured to first piston 60, a second rack gear 92 secured to second piston 70 and a pinion gear 94 rotatably journaled relative to support frame 12. Each pinion gear 94 is rotatably journaled on an L-shaped bracket 96 that is secured to a backplate 100 by means of screws 98. As is shown in FIG. 3, rack gears 90 are located in slots 102 formed on the lower or second peripheral end of first piston 60 and are retained in slots 102 by means of screws 104. Similarly, rack gears 92 are positioned in slots 106 formed in the second end of second piston 70, opposite doming die 82 and are held in position by means of a plug or gear rack retainer 110 mounted by means of bolt 108 that is threadably received in second piston 70. The counteracting movement of first and second pistons 60 and 70 along with pressure ring 76 and doming die 82 may be more fully appreciated, now, especially in reference to FIGS. 6(*a*)–6(*d*). At the start of the dome forming cycle, ram 18 carries container 30 thereon with container 30 being advanced in the first direction "x" until bottom panel 34 comes into contact with pressure ring 76. As ram 18 continues to advance the container into pressure ring 76, peripheral edge 36 begins to reform into the profile of pressure ring 76. This forcibly movement simultaneously begins to move first piston 60 in the direction "x". Since pistons 60 and 70 are linked by gear sets 88 (not shown), advancement of first piston 60 in the direction "x" causes second piston 70 to move in direction "y" that is opposite first direction "x" so that doming die 82 increasingly deforms bottom panel 34 from the configuration shown in FIG. 6(*a*) to the formed configuration shown in FIGS. 6(*b*)–6(*d*). At this point, piston retaining ring 66 contacts the first end 71 of piston 70. This provides a travel limit stop which prevents further relative movement of first and second pistons 60 and 70. In order to compensate for the inertia of ram 18, however, cushioning is provided by means of urethane die springs 52 which may slightly flex to absorb the impact of the stamping operation. This is best shown in FIG. 6(*c*). Housing 42 may axially move slightly in eccentrics 54 and 56 to accommodate this impact, with clamps 55 holding eccentrics 54 and 56 in position against support frame 12.

After the dome structure is formed, at FIG. 6(*d*), ram 18 retracts in the direction "y" so that the formed container may be removed from forming apparatus 10. To assist this, an air piston assembly 28 is provided, as is best shown in FIGS. 3–5. Here, air piston assembly 28 includes a piston housing 114 that is disposed on piston housing 42, specifically, on backplate 100. Air piston 116 is disposed in air piston housing 114, and seals 118 are provided to maintain an air tight contact between the outer peripheral wall 120 of air piston 116 and the interior sidewall of air piston housing 114.

As is shown in FIG. 5, backplate 100 includes a plurality of openings 121 formed therethrough with openings 121 being equiangularly spaced around the central longitudinal axis of forming apparatus 10. Bushings 122 are positioned in each opening 121 and a piston rod 124 is slidably received through each bushing 122. Piston rods 124, as is shown in FIGS. 3 and 5, interconnect air piston 116 and first piston 60. Pressurized air which is supplied into the interior 126 of air piston housing 114 through an inlet formed by nipple connector 128 acts to cushion movement of piston 60 in the first direction and thus piston 70 in the second direction. The increased compression resulting from movement of piston 60 in the first direction also operates both to control metal flow at edge 36 of container 30 and to resiliently restore piston 60 to the location shown in FIGS. 6(*a*) and 6(*d*). This restoration facilitates ejection of the formed container from pressure ring 62 and dome die 82.

From the foregoing description, it should be appreciated that the double action of pistons 60 and 70 reduce by approximately fifty percent the stroke length of ram 18 that is necessary to form dome structure 40. For example, then, where dome structure 40 is approximately 0.400 inch in height, a stroke distance of about 0.230 to 0.250 is necessary since this stroke distance is doubled by the double acting pistons. By reducing this stroke distance, the speed of ram 18 that carries the unformed container 30 as it impacts the pressure ring 62 and doming die 82 is greatly reduced as contact now occurs closer to the bottom of the cam drive for the bodymaker. This velocity is now reduced to approximately 2–4 feet per second instead of the velocity of approximately 20 feet per second noted in the background of this invention. Thus, the impact energy would be less than five percent for this velocity difference.

Accordingly, the present invention has been described with some degree of particularity directed to the exemplary embodiment of the present invention. It should be appreciated, though, that the present invention is defined by the following claims construed in light of the prior art so that modifications or changes may be made to the exemplary embodiments of the present invention without departing from the inventive concepts contained herein.

I claim:

1. A forming apparatus mountable on a support frame and operative to form a dome structure in a bottom panel of a container wherein said container having a bottom peripheral edge surrounding said bottom panel, comprising:

(a) a first piston reciprocally movable in opposite first and second directions relative to said support frame;

(b) a second piston reciprocally movable in the first and second directions relative to said first piston;

(c) a mechanical linkage interconnecting said first and second pistons such that movement of one of said first and second pistons respectively in the first and second directions causes counter movement of another of said first and second pistons in an opposite direction;

(d) a pressure ring disposed on said first piston and operative to engage the bottom peripheral edge of said container and configured to reform said bottom peripheral edge to produce a desired shoulder profile as the container is forcibly advanced in the first direction; and (e) a doming die disposed on said second piston and reciprocally movable with said second piston in said first and second directions relative to said first piston and operative to engage the bottom panel of said container and configured to deform said bottom panel into a desired dome structure as the container is forcibly advanced in the first direction relative to the second piston.

2. A forming apparatus according to claim 1 wherein said mechanical linkage includes a gear drive interconnecting said first and second pistons.

3. A forming apparatus according to claim 1 wherein said first and second piston are coaxial with respect to one another.

4. A forming apparatus according to claim 1 including an eccentric adjustment assembly operative to orient the first and second direction of travel of said first and second pistons relative to said support frame.

5. A forming apparatus according to claim 1 wherein advancement of the container in the first direction against said pressure ring causes said first piston to travel in the first direction and said second piston to travel in the second direction.

6. A forming apparatus according to claim 1 including a limiter operative upon engagement to prevent movement of said first piston in the first direction and counter movement of said second piston in the second direction and a cushion element operative to resiliently dampen movement of the container in the first direction when said limiter engages.

7. A forming apparatus according to claim 2 wherein said gear drive includes a first gear rack secured to said first piston, a second gear rack secured to said second piston and a pinion gear secured relative to said support frame and engaging both said first and second gear rack whereby linear movement of said first gear rack causes movement of said second gear rack in an opposite direction.

8. A forming apparatus according to claim 3 wherein said first piston is configured as a cylindrical shell and wherein said second piston is configured as a cylinder disposed internally of said first piston, said pressure ring being annular in shape.

9. A forming apparatus according to claim 5 including an air actuated piston in communication with a source of pressurized air.

10. A forming apparatus operative to form a dome structure in a bottom panel of a container wherein said container has a bottom peripheral edge surrounding said bottom panel and wherein a ram acts to advance the container in a linear first direction, comprising:

(a) a support frame;

(b) a piston housing secured to said support frame and having a housing interior formed by a surrounding sidewall extending longitudinally from a top end to a bottom end, said piston housing having a longitudinal axis;

(c) a first piston formed as a shell having an outer piston wall, an inner piston wall and a piston interior, said first piston being disposed in the housing interior and axially aligned with the longitudinal axis, said first piston being reciprocally movable in a first direction toward the bottom end and an opposite second direction toward the top end with said outer piston wall sliding alongside the surrounding sidewall of said piston housing;

(d) a second piston disposed in the piston interior and axially aligned with the longitudinal axis, said second piston reciprocally movable in the first and second directions relative to said first piston;

(e) a rack gear set including a first rack gear secured to said first piston, a second rack gear secured to said second piston and a pinion gear secured relative to said piston housing and rotatably journaled so as to mechanically link said first and second rack gears such that movement of one of said first and second pistons respectively in the first and second directions causes counter movement of another of said first and second pistons in an opposite direction;

(f) a pressure ring disposed on said first piston and operative to engage the bottom peripheral edge of said container and configured to reform said bottom peripheral edge to produce a desired shoulder profile as the container is forcibly advanced in the first direction by said ram; and (g) a doming die disposed on said second piston and operative to engage the bottom panel of said container and configured to deform said bottom panel into a desired dome structure as the container is forcibly advanced in the first direction relative to the second piston.

11. A forming apparatus according to claim 10 including a plurality of rack gear sets each including a first rack gear secured to said first piston, a second rack gear secured to said second piston and a pinion gear secured relative to said piston housing and rotatably journaled so as to mechanically link a respective on of said first and second rack gears, said rack gear sets being equiangularly spaced around the longitudinal axis.

12. A forming apparatus according to claim 10 wherein said piston housing includes an outer flange secured to said support frame and including a resilient die spring interposed between said flange and said support frame.

13. A forming apparatus according to claim 10 including an eccentric adjustment assembly operative to align the longitudinal axis with said ram.

14. A forming apparatus according to claim 10 including a first piston seal operative to maintain sealing contact between said first piston and the surrounding sidewall of said piston housing and a second piston seal operative to maintain sealing contact between said second piston and the inner piston wall.

15. A forming apparatus according to claim 10 wherein said piston housing and said first and second pistons are circular in cross-section.

16. A forming apparatus according to claim 10 including a back plate disposed on the bottom end of said piston housing, said pinion gear being mounted to said back plate.

17. A forming apparatus according to claim 10 including an air piston disposed on the bottom end of said piston housing and operative to cushion movement of said first piston in the first direction and said second piston in the second direction, said air piston in fluid communication with a source of pressurized air.

18. A forming apparatus according to claim 14 including a first annular piston retaining ring disposed on the top end of said piston housing and operative to limit travel of said first piston in the second direction and thereby limit travel of said second piston in the first direction and a second annular piston retaining ring disposed on a top portion of said first piston and operative to limit travel of said second piston in the second direction and thereby limit travel of said first piston in the first direction.

19. A forming apparatus according to claim 15 wherein said support frame includes a circular opening formed therein, said piston housing being disposed in the circular opening.

20. A forming apparatus according to claim 15 including an annular eccentric element disposed in the circular opening and surrounding said piston housing, said eccentric element operative to align the longitudinal axis with said ram.

21. A forming apparatus according to claim 17 including an annular back plate disposed on the bottom end of said piston housing, said air piston including a plurality of air piston rods extending longitudinally through respective guide bushings mounted in holes formed in said back plate.

22. A forming apparatus according to claim 21 wherein said air piston rods are equiangularly spaced about the longitudinal axis.

23. A forming apparatus mountable on a support frame and operative to form a dome structure in a bottom panel of a container wherein said container having a bottom peripheral edge surrounding said bottom panel, comprising:

(a) a first piston reciprocally movable in opposite first and second directions relative to said support frame;

(b) a second piston reciprocally movable in the first and second directions relative to said first piston;

(c) a plurality of gear sets interconnecting said first and second pistons such that movement of one of said first and second pistons respectively in the first and second directions causes counter movement of another of said first an second pistons in an opposite direction, including a first gear rack secured to said first piston, a second gear rack secured to said second piston and a pinion gear secured relative to said support frame and engaging both said first and second gear rack whereby linear movement of said first gear rack causes movement of said second gear rack in an opposite direction, said gear sets being disposed equiangularly around said first and second pistons;

(d) a pressure ring disposed on said first piston and operative to engage the bottom peripheral edge of said container and configured to reform said bottom peripheral edge to produce a desired shoulder profile as the container is forcibly advanced in the first direction; and (e) a doming die disposed on said second piston and reciprocally movable with said second piston in said first and second directions relative to said first piston and operative to engage the bottom panel of said container and configured to deform said bottom panel into a desired dome structure as the container is forcibly advanced in the first direction relative to the second piston.

* * * * *